US009862905B2

(12) United States Patent
Prakash

(10) Patent No.: US 9,862,905 B2
(45) Date of Patent: Jan. 9, 2018

(54) DIESEL FUEL WITH IMPROVED IGNITION CHARACTERISTICS

(71) Applicant: SHELL OIL COMPANY, Houston, TX (US)

(72) Inventor: Arjun Prakash, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 169 days.

(21) Appl. No.: 14/680,234

(22) Filed: Apr. 7, 2015

(65) Prior Publication Data

US 2015/0284652 A1 Oct. 8, 2015

Related U.S. Application Data

(60) Provisional application No. 61/976,837, filed on Apr. 8, 2014.

(51) Int. Cl.

| | |
|---|---|
| ***C10L 1/24*** | (2006.01) |
| ***C10L 10/12*** | (2006.01) |
| ***C10L 1/22*** | (2006.01) |
| ***F02B 47/04*** | (2006.01) |
| ***F02B 3/08*** | (2006.01) |
| ***C10L 1/232*** | (2006.01) |
| ***C10L 1/226*** | (2006.01) |
| *C10L 1/23* | (2006.01) |

(52) U.S. Cl.

CPC ..... *C10L 10/12* (2013.01); *C10L 1/22* (2013.01); *C10L 1/226* (2013.01); *C10L 1/232* (2013.01); *F02B 3/08* (2013.01); *F02B 47/04* (2013.01); *C10L 1/231* (2013.01); *C10L 2200/0259* (2013.01); *C10L 2200/0446* (2013.01); *C10L 2270/026* (2013.01)

(58) Field of Classification Search

CPC .. C10L 10/12; C10L 1/22; C10L 1/232; C10L 1/231; C10L 1/226; C10L 2200/0259; C10L 2200/0446; C10L 2270/026; F02B 47/04; F02B 3/08

See application file for complete search history.

(56) References Cited

U.S. PATENT DOCUMENTS

| | | | | |
|---|---|---|---|---|
| 2,225,879 | A | 12/1940 | Pharis et al. | |
| 2,877,102 | A * | 3/1959 | Levesque | C10L 1/226 44/328 |
| 3,357,865 | A | 12/1967 | Davis et al. | |
| 4,723,964 | A | 2/1988 | Jessup et al. | |
| 5,349,188 | A | 9/1994 | Maggard | |
| 5,378,348 | A | 1/1995 | Davis et al. | |
| 5,766,274 | A | 6/1998 | Wittenbrink et al. | |

(Continued)

FOREIGN PATENT DOCUMENTS

| | | |
|---|---|---|
| EP | 0583836 | 2/1994 |
| EP | 981959 | 3/2000 |

(Continued)

OTHER PUBLICATIONS

Declaration of Andrea Birgit Schuetze executed Nov. 24, 2015.
International Search Report dated Jul. 6, 2015 of PCT/US2015/024605 filed Apr. 7, 2015.

*Primary Examiner* — Latosha Hines

(57) ABSTRACT

Diheterocyclo diazene dicarboxamides have been found to effectively reduce the ignition delay and/or as effective cetane number improvers in diesel fuels and is suitable for use in modern engines.

15 Claims, 1 Drawing Sheet

(56) References Cited

U.S. PATENT DOCUMENTS

| | | | |
|---|---|---|---|
| 5,888,376 | A | 3/1999 | Wittenbrink et al. |
| 6,204,426 | B1 | 3/2001 | Miller et al. |
| 2014/0230320 | A1 | 8/2014 | Prakash et al. |

FOREIGN PATENT DOCUMENTS

| | | | | | |
|---|---|---|---|---|---|
| EP | 1101813 | | | 11/2000 | |
| GB | 2460460 | A | * | 12/2009 | ..... B01D 15/00 |
| WO | 1997014768 | | | 4/1997 | |
| WO | 1997014769 | | | 4/1997 | |
| WO | 2000011116 | | | 3/2000 | |
| WO | 2000011117 | | | 3/2000 | |
| WO | 2000020534 | | | 4/2000 | |
| WO | 2000020535 | | | 4/2000 | |
| WO | 2000183406 | | | 11/2001 | |
| WO | 2000183641 | | | 11/2001 | |
| WO | 2000183647 | | | 11/2001 | |
| WO | 2000183648 | | | 11/2001 | |

* cited by examiner

DIESEL FUEL WITH IMPROVED IGNITION CHARACTERISTICS

The present application claims the benefit of U.S. Provisional Application Ser. No. 61/976,837, filed Apr. 8, 2014, the entire disclosure of which is hereby incorporated by reference.

FIELD OF THE INVENTION

The present invention relates to diesel fuels having improved ignition characteristics, more particularly to diesel fuels with enhanced cetane numbers.

BACKGROUND OF THE INVENTION

The cetane number of a fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to lower engine noise, to alleviate white smoke ("cold smoke") caused by incomplete combustion.

There is a general preference, therefore, for a diesel fuel composition to have a high cetane number, a preference which has become stronger as emissions legislation grows increasingly stringent, and as such automotive diesel specifications generally stipulate a minimum cetane number. To this end, many diesel fuel compositions contain ignition improvers, also known as cetane boost additives or cetane (number) improvers/enhancers, to ensure compliance with such specifications and generally to improve the combustion characteristics of the fuel.

Further, thermal stability is an important attribute of diesel fuel quality because of its function as a heat transfer fluid. Poor thermal stability, for example, may result in premature fuel filter plugging.

Currently, the most commonly used diesel fuel ignition improver is 2-ethylhexyl nitrate (2-EHN), which operates by shortening the ignition delay of a fuel to which it is added. However, 2-EHN can potentially have an adverse effect on the thermal stability of a fuel as it forms free radicals on decomposition at relatively low temperatures. 2-EHN begins to decompose at about 43° C. at atmospheric pressure. Poor thermal stability also results in an increase in the products of instability reactions, such as gums, lacquers and other insoluble species. These products can block engine filters and foul fuel injectors and valves, and consequently can result in loss of engine efficiency or emissions control.

2-EHN can also be difficult to store in concentrated form as it tends to decompose, and so is prone to forming potentially explosive mixtures. Furthermore, it has been noted that 2-EHN functions most effectively under mild engine conditions.

These disadvantages mean that it would be generally desirable to replace 2-EHN, whilst at the same time maintaining acceptable combustion properties.

SUMMARY OF THE INVENTION

It has now been found that diheterocyclo diazene dicarboxamide compounds can serve to reduce the ignition delay and/or as effective cetane number improvers in diesel fuels, while being more stable to decomposition than 2-EHN.

Accordingly, in an embodiment, there is provided a composition comprising a diesel base fuel and at least one diheterocyclo diazene dicarboxamide.

The diheterocyclo diazene dicarboxamides have been found to effectively reduce the ignition delay and/or as effective cetane number improvers in diesel fuels and are suitable for use in modern engines.

Still yet another aspect of the invention relates to a method of operating a compression ignition engine and/or a vehicle which is powered by such an engine, which method involves introducing into a combustion chamber of the engine a diesel fuel composition containing at least one diheterocyclo diazene dicarboxamide.

BRIEF DESCRIPTION OF THE DRAWINGS

This drawing illustrates certain aspects of some of the embodiments of the invention, and should not be used to limit or define the invention.

DETAILED DESCRIPTION OF THE INVENTION

Figure 1:
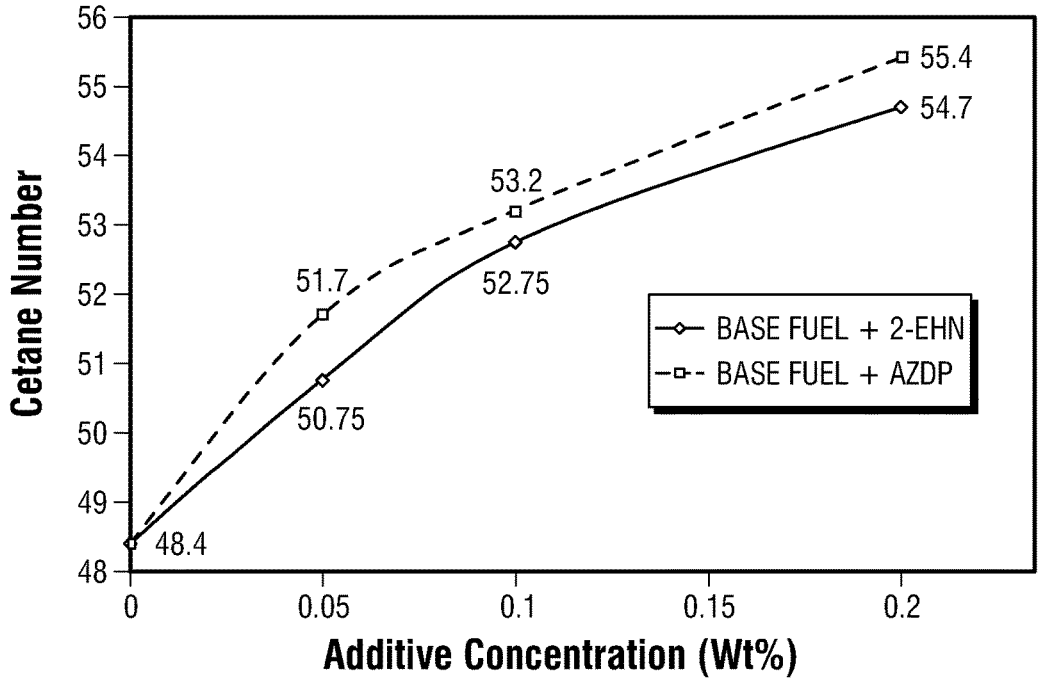
FIG. 1 illustrates the increase in cetane number with the addition of azodicarbonyl dipiperidine, a diheterocyclo diazene dicarboxamide, and compares it to increase in cetane number obtained with the addition of 2-EHN.

In order to assist with the understanding of the invention several terms are defined herein.

The terms "cetane (number) improver" and "cetane (number) enhancer" are used interchangeably to encompass any component that, when added to a fuel composition at a suitable concentration, has the effect of increasing the cetane number of the fuel composition relative to its previous cetane number under one or more engine conditions within the operating conditions of the respective fuel or engine. The term cetane number improvers/enhancers of the invention are diheterocyclo diazene dicarboxamide as described herein. As used herein, a cetane number improver or enhancer may also be referred to as a cetane number increasing additive/agent or the like.

In accordance with the present invention, the cetane number of a fuel composition may be determined in any known manner, for instance using the standard test procedure ASTM D613 (ISO 5165, IP 41) which provides a so-called "measured" cetane number obtained under engine running conditions. More preferably the cetane number may be determined using the more recent and accurate "ignition quality test" (IQT; ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels. Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

The composition comprises a liquid hydrocarbon fuel, to which has been added at least one diheterocyclo diazene dicarboxamide. The term "heterocyclo" means a cyclic hetero atom containing substituent (e.g., alicyclic group containing nitrogen group in the cyclic group). The diheterocyclo diazene dicarboxamide preferably is a compound having the formula:

(Formula I)

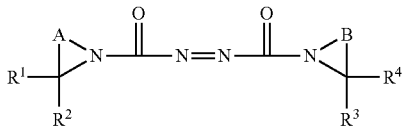

wherein $R^1$, $R^2$, $R^3$ and $R^4$ are each independently selected from alkyl groups or hydrogen, and A and B are same or different alkylene group having 3 to 5 carbon atoms or nitrogen containing aliphatic group having 1 nitrogen atom and 2 to 4 carbon atoms. Each of the carbon atoms in A and B may optionally be substituted with the same or different groups

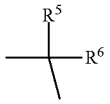

wherein $R^5$ and $R^6$ are each independently selected from alkyl groups and hydrogen. When $R^1$, $R^2$, $R^3$, $R^4$, $R^5$, and/or $R^6$ is an alkyl group, preferably the alkyl groups have 1 to 5 carbon atoms.

Examples of the diheterocyclo diazene dicarboxamide suitable for the present invention include the following with a general formula

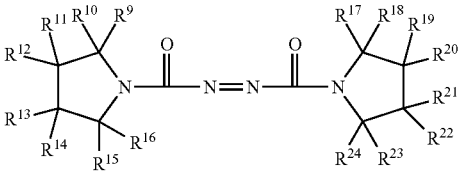

wherein $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$ are each independently selected from the group consisting of hydrogen atoms and alkyl groups. If an alkyl group, preferably the alkyl group have 1 to 5 carbon atoms.

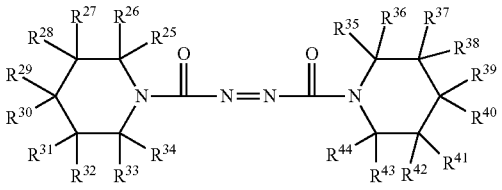

wherein, $R^{25}$, $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$, $R^{41}$, $R^{42}$, $R^{43}$, $R^{44}$ are each independently selected from the group consisting of hydrogen atoms and alkyl groups. If an alkyl group, preferably the alkyl group have 1 to 5 carbon atoms.

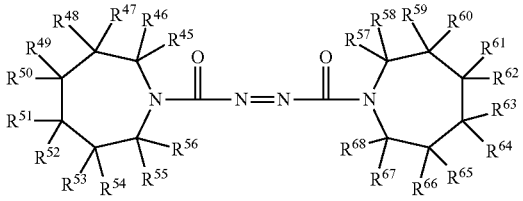

wherein, $R^{45}$, $R^{46}$, $R^{47}$, $R^{48}$, $R^{49}$, $R^{50}$, $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$ are each independently selected from the group consisting of hydrogen atoms and alkyl groups. If an alkyl group, preferably the alkyl group have 1 to 5 carbon atoms. The diheterocyclo diazene dicarboxamide may also have the formula:

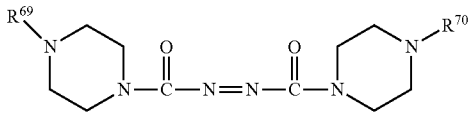

wherein $R^{69}$, $R^{70}$ are each independently selected from hydrogen or alkyl groups having 1 to 4 carbon atoms.

A suitable diheterocyclo diazene dicarboxamide is available commercially such as from Sigma Aldrich Co, VWR International LLC, and ABI Chem. In addition, the diheterocyclo diazene dicarboxamide can be prepared by methods known in the art, such as for example disclosed in U.S. Pat. No. 3,357,865 which disclosure is hereby incorporated by reference. As an example, dihydrocarbyl azodicarboxylate can be reacted with a heterocycloamine. A representative reaction can be shown as:

(Equation I)

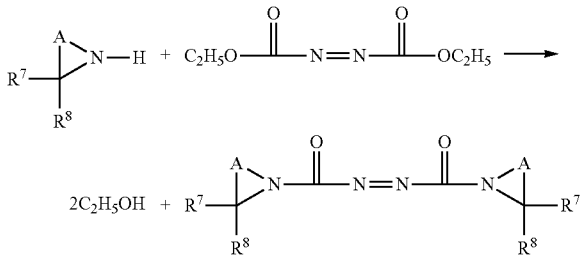

wherein $R^7$ and $R^8$ are the same or different groups selected hydrogen and alkyl groups and A and B are same or different alkylene group having 3 to 5 carbon atoms.

Suitable diheterocyclo diazene dicarboxamide include, for example, 1,1'-Azobis(N,N-pentamethyleneformamide) (azodicarbonyl dipipeidine) and 1,1'-Azobis(N,N-tetramethyleneformamide) (methanone, 1,1'-(1,2-diazenediyl)bis[1-(1-pyrrolidinyl)]-diimide) and 3-[(1-{3-[2-(Trifluoromethyl)-10H-Phenothiazin-10-yl]Propyl}Piperidin-4-yl)oxyl] Propan-1-ol Ethanedioate (Methanone, 1,1'-(1,2-diazenediyl)bis[1-(4-methyl-1-piperazinyl)-).

The diheterocyclo diazene dicarboxamide may be present in the diesel fuel composition at a concentration from about 0.005 to about 5 percent by weight. Preferred amounts are about 0.005 to about 2 percent by weight, with more preferred amounts being about 0.005 to about 1 percent by weight. The upper limit of these ranges will be determined primarily by solubility of the diheterocyclo diazene dicarboxamide in a fuel and by the cost of the additive, since large amounts of additive can increase the cost of producing the fuel.

The diheterocyclo diazene dicarboxamide can serve to reduce the ignition delay and/or as effective cetane number improvers in diesel fuels, while being more stable to decomposition than 2-EHN. Because they contain amide functional groups, diazene dicarboxamides possess stability through resonance: the N—CO bonds, $\Delta H°=86$ kcal/mol, of diazene dicarboxamides have some double bond character, C═N, $\Delta H°=147$ kcal/mol, resulting in a $\Delta H°$ somewhere between the two energies. On the other hand, the energy required to dissociate the N—O bond of 2-EHN is less, $\Delta H°=55$ kcal/mol. Therefore, 2-EHN decomposes at lower temperatures than diheterocyclo diazene dicarboxamides.

The diheterocyclo diazene dicarboxamide can be added with a hydrocarbon compatible co-solvent that can enhance miscibility of the diheterocyclo diazene dicarboxamide to the hydrocarbon base fuel such as, for example, alcohol. However, the diheterocyclo diazene dicarboxamide can be used in the fuel without the use of a co-solvent due to its miscibility in fuel. If co-solvent is used, alcohol having 1 to 20 carbon atoms is preferred. Alcohol having 2 to 18 carbons atoms are further preferred for vehicle use. The amount of co-solvent if present in the composition can be in the range of from 0 to 10% w/w, preferably 0 to 5% w/w, based on the fuel composition.

The fuel compositions to which the present invention relates include diesel fuels for use in automotive compression ignition engines, as well as in other types of engine such as for example marine, railroad and stationary engines, and industrial gas oils for use in heating applications (e.g. boilers).

The base fuel may itself comprise a mixture of two or more different diesel fuel components, and/or be additivated as described below.

Such diesel fuels will contain a base fuel which may typically comprise liquid hydrocarbon middle distillate gas oil(s), for instance petroleum derived gas oils. Such fuels will typically have boiling points with the usual diesel range of 150 to 400° C., depending on grade and use. They will typically have a density from 750 to 900 kg/m$^3$, preferably from 800 to 860 kg/m$^3$, at 15° C. (e.g. ASTM D4502 or IP 365) and a cetane number (ASTM D613) from 35 to 80, more preferably from 40 to 75. They will typically have an initial boiling point in the range 150 to 230° C. and a final boiling point in the range 290 to 400° C. Their kinematic viscosity at 40° C. (ASTM D445) might suitably be from 1.5 to 4.5 mm$^2$/s.

Such industrial gas oils will contain a base fuel which may comprise fuel fractions such as the kerosene or gas oil fractions obtained in traditional refinery processes, which upgrade crude petroleum feedstock to useful products. Preferably such fractions contain components having carbon numbers in the range 5-40, more preferably 5-31, yet more preferably 6-25, most preferably 9-25, and such fractions have a density at 15° C. of 650-950 kg/m$^3$, a kinematic viscosity at 20° C. of 1-80 mm$^2$/s, and a boiling range of 150-400° C. Optionally, non-mineral oil based fuels, such as bio-fuels or Fischer Tropsch derived fuels, may also form or be present in the fuel composition.

A petroleum derived gas oil, e.g. obtained from refining and optionally (hydro)processing a crude petroleum source, may be incorporated into a diesel fuel composition. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit, and gas oil as obtained from a hydrocracker unit. Optionally, a petroleum derived gas oil may comprise some petroleum derived kerosene fraction. Such gas oils may be processed in a hydro-desulfurisation (HDS) unit so as to reduce their sulfur content to a level suitable for inclusion in a diesel fuel composition. This also tends to reduce the content of other polar species such as oxygen- or nitrogen-containing species. In some cases, the fuel composition will include one or more cracked products obtained by splitting heavy hydrocarbons.

The amount of Fischer-Tropsch derived fuel used in a diesel fuel composition may be from 0.5 to 100% v of the overall diesel fuel composition, preferably from 5 to 75% v. It may be desirable for the composition to contain 10% v or greater, more preferably 20% v or greater, still more preferably 30% v or greater, of the Fischer-Tropsch derived fuel. It is particularly preferred for the composition to contain 30 to 75% v, and particularly 30 or 70% v, of the Fischer Tropsch derived fuel. The balance of the fuel composition is made up of one or more other fuels.

An industrial gas oil composition may comprise more than 50 wt %, more preferably more than 70 wt %, of a Fischer Tropsch derived fuel component, if present. Fischer-Tropsch fuels may be derived by converting gas, biomass or coal to liquid (XtL), specifically by gas to liquid conversion (GtL), or from biomass to liquid conversion (BtL). Any form of Fischer-Tropsch derived fuel component may be used as a base fuel in accordance with the invention. Such a Fischer Tropsch derived fuel component is any fraction of the middle distillate fuel range, which can be isolated from the (hydrocracked) Fischer Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP A 0583836, WO A 97/14768, WO A 97/14769, WO A 00/11116, WO A 00/11117, WO A 01/83406, WO A 01/83648, WO A 01/83647, WO A 01/83641, WO A 00/20535, WO A 00/20534, EPA 1101813, U.S. Pat. No. 5,766,274, U.S. Pat. No. 5,378,348, U.S. Pat. No. 5,888,376 and U.S. Pat. No. 6,204,426, the disclosures are hereby incorporated by reference.

The Fischer-Tropsch product will suitably contain more than 80 wt % and more suitably more than 95 wt % iso and normal paraffins and less than 1 wt % aromatics, the balance being naphthenics compounds. The content of sulfur and nitrogen will be very low and normally below the detection limits for such compounds. For this reason the sulfur content of a fuel composition containing a Fischer-Tropsch product may be very low.

The fuel composition preferably contains no more than 5000 ppmw sulfur, more preferably no more than 500 ppmw, or no more than 350 ppmw, or no more than 150 ppmw, or no more than 100 ppmw, or no more than 50 ppmw, or most preferably no more than 10 ppmw sulfur.

In some embodiments of the present invention, the base fuel may be or contain another so-called "biodiesel" fuel component, such as a vegetable oil, hydrogenated vegetable oil or vegetable oil derivative (e.g. a fatty acid ester, in particular a fatty acid methyl ester, FAME), or another oxygenate such as an acid, ketone or ester. Such components need not necessarily be bio-derived. Where the fuel composition contains a biodiesel component, the biodiesel component may be present in quantities up to 100%, such as between 1% and 99% w/w, between 2% and 80% w/w, between 2% and 50% w/w, between 3% and 40% w/w, between 4% and 30% w/w, or between 5% and 20% w/w. In one embodiment the biodiesel component may be FAME.

The diheterocyclo diazene dicarboxamide may be used to increase the cetane number of a fuel composition. As used herein, an "increase" in the context of cetane number embraces any degree of increase compared to a previously measured cetane number under the same or equivalent conditions. Thus, the increase is suitably compared to the cetane number of the same fuel composition prior to incorporation of the cetane number increasing (or improving) component or additive. Alternatively, the cetane number increase may be measured in comparison to an otherwise analogous fuel composition (or batch or the same fuel composition) that does not include the cetane number enhancer of the invention. Alternatively, an increase in cetane number of a fuel relative to a comparative fuel may be inferred by a measured increase in combustability or a measured decrease in ignition delay for the comparative fuels.

The increase in cetane number (or the decrease in ignition delay, for example) may be measured and/or reported in any suitable manner, such as in terms of a percentage increase or decrease. By way of example, the percentage increase or decrease may be at least 1%, such as at least 2%, (for example, at a dosage level of 0.05%). Suitably, the percentage increase in cetane number or decrease in ignition delay is at least 5%, at least 10%. However, it should be appreciated that any measurable improvement in cetane number or ignition delay may provide a worthwhile advantage, depending on what other factors are considered important, e.g. availability, cost, safety and so on.

The engine in which the fuel composition of the invention is used may be any appropriate engine. Thus, where the fuel is a diesel or biodiesel fuel composition, the engine is a diesel or compression ignition engine. Likewise, any type of diesel engine may be used, such as a turbo charged diesel engine, provided the same or equivalent engine is used to measure fuel economy with and without the cetane number increasing component. Similarly, the invention is applicable to an engine in any vehicle. Generally, the cetane number improvers of the invention are suitable for use over a wide range of engine working conditions.

The remainder of the composition will typically consist of one or more automotive base fuels optionally together with one or more fuel additives, for instance as described in more detail below.

The relative proportions of the cetane number enhancer, fuel components and any other components or additives present in a diesel fuel composition prepared according to the invention may also depend on other desired properties such as density, emissions performance and viscosity.

Thus, in addition to diheterocyclo diazene dicarboxamide, a diesel fuel composition prepared according to the present invention may comprise one or more diesel fuel components of conventional type. It may, for example, include a major proportion of a diesel base fuel, for instance of the type described below. In this context, a "major proportion" means at least 50% w/w, and typically at least 75% w/w based on the overall composition, more suitably, at least 80% w/w or even at least 85% w/w. In some cases at least 90% w/w or at least 95% w/w of the fuel composition consists of the diesel base fuel. Furthermore, in some cases at least 95% w/w or at least 99.99% w/w of the fuel composition consists of the diesel base fuel.

Such fuels are generally suitable for use in compression ignition (diesel) internal combustion engines, of either the indirect or direct injection type.

An automotive diesel fuel composition which results from carrying out the present invention will also suitably fall within these general specifications. Accordingly, it will generally comply with applicable current standard specification(s) such as for example EN 590 (for Europe) or ASTM D975 (for the USA). By way of example, the fuel composition may have a density from 0.82 to 0.845 g/cm$^3$ at 15° C.; a $T_{95}$ boiling point (ASTM D86) of 360° C. or less; a cetane number (ASTM D613) of 45 or greater; a kinematic viscosity (ASTM D445) from 2 to 4.5 mm$^2$/s at 40° C.; a sulfur content (ASTM D2622) of 50 mg/kg or less; and/or a polycyclic aromatic hydrocarbons (PAH) content (IP391 (mod)) of less than 11% w/w. Relevant specifications may, however, differ from country to country and from year to year and may depend on the intended use of the fuel composition.

In particular, its measured cetane number will preferably be from 40 to 70. The present invention suitably results in a fuel composition which has a derived cetane number (IP 498) of 40 or greater, more preferably of 41, 42, 43, or 44 or greater.

Furthermore, a fuel composition prepared according to the present invention, or a base fuel used in such a composition may contain one or more fuel additives, or may be additive-free. If additives are included (e.g. added to the fuel at the refinery), it may contain minor amounts of one or more additives. Selected examples or suitable additives include (but are not limited to): anti-static agents; pipeline drag reducers; flow improvers (e.g. ethylene/vinyl acetate copolymers or acrylate/maleic anhydride copolymers); lubricity enhancing additives (e.g. ester- and acid-based additives); viscosity improving additives or viscosity modifiers (e.g. styrene-based copolymers, zeolites, and high viscosity fuel or oil derivatives); dehazers (e.g. alkoxylated phenol formaldehyde polymers); anti-foaming agents (e.g. polyether-modified polysiloxanes); anti-rust agents (e.g. a propane-1, 2-diol semi-ester of tetrapropenyl succinic acid, or polyhydric alcohol esters of a succinic acid derivative); corrosion inhibitors; reodorants; anti-wear additives; antioxidants (e.g. phenolics such as 2,6-di-tert-butylphenol); metal deactivators; combustion improvers; static dissipator additives; cold flow improvers (e.g. glycerol monooleate, di-isodecyl adipate); antioxidants; and wax anti-settling agents. The composition may for example contain a detergent. Detergent-containing diesel fuel additives are known and commercially available. Such additives may be added to diesel fuels at levels intended to reduce, remove or slow the build-up of engine deposits. In some embodiments, it may be advantageous for the fuel composition to contain an anti-foaming agent, more preferably in combination with an anti-rust agent and/or a corrosion inhibitor and/or a lubricity enhancing additive.

Where the composition contains such additives (other than the diheterocyclo diazene dicarboxamide and/or co-solvent), it suitably contains a minor proportion (such as 1% w/w or less, 0.5% w/w or less, 0.2% w/w or less), of the one or more other fuel additives, in addition to the diheterocyclo diazene. Unless otherwise stated, the (active matter) concentration of each such other additive component in the fuel composition may be up to 10000 ppmw, such as in the range of 0.1 to 1000 ppmw; and advantageously from 0.1 to 300 ppmw, such as from 0.1 to 150 ppmw.

If desired, one or more additive components, such as those listed above, may be co-mixed (e.g. together with suitable diluent) in an additive concentrate, and the additive concentrate may then be dispersed into a base fuel or fuel composition. In some cases, it may be possible and convenient to incorporate the cetane number increasing component of the invention into such an additive formulation. Thus, the diheterocyclo diazene dicarboxamide may be pre-diluted in one or more such fuel components, prior to its incorporation into the final automotive fuel composition. Such a fuel additive mixture may typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol (e.g. 1-butanol, hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

The total content of the additives in the fuel composition may be suitably between 0 and 10000 ppmw and more suitably below 5000 ppmw.

As used herein, amounts (e.g. concentrations, ppmw and % w/w) of components are of active matter, i.e. exclusive of volatile solvents/diluent materials.

In one embodiment, the present invention involves adjusting the cetane number of the fuel composition, using the cetane number enhancing component, in order to achieve a desired target cetane number.

The maximum cetane number of an automotive fuel composition may often be limited by relevant legal and/or commercial specifications, such as the European diesel fuel specification EN 590 that stipulates a cetane number of 51. Thus, typical commercial automotive diesel fuels for use in Europe are currently manufactured to have cetane numbers of around 51. Thus, the present invention may involve manipulation of an otherwise standard specification diesel fuel composition, using a cetane number enhancing additive, to increase its cetane number so as to improve the combustability of the fuel, and hence reduce engine emissions and even fuel economy of an engine into which it is, or is intended to be, introduced.

Suitably, the cetane number improver increases the cetane number of the fuel composition by at least 2, preferably at least 3, cetane numbers. Accordingly, in other embodiments, the cetane number of the resultant fuel is between 42 and 60, preferably between 43 and 60.

An automotive diesel fuel composition prepared according to the present invention will suitably comply with applicable current standard specification(s) such as, for example, EN 590 (for Europe) or ASTM D-975 (for the USA). By way of example, the overall fuel composition may have a density from 820 to 845 kg/m$^3$ at 15° C. (ASTM D-4052 or EN ISO 3675); a T95 boiling point (ASTM D-86 or EN ISO 3405) of 360° C. or less; a measured cetane number (ASTM D-613) of 51 or greater; a VK 40 (ASTM D-445 or EN ISO 3104) from 2 to 4.5 mm$^2$/s; a sulfur content (ASTM D-2622 or EN ISO 20846) of 50 mg/kg or less; and/or a polycyclic aromatic hydrocarbons (PAH) content (IP 391 (mod)) of less than 11% w/w. Relevant specifications may, however, differ from country to country and from year to year, and may depend on the intended use of the fuel composition.

It will be appreciated, however, that diesel fuel composition prepared according to the present invention may contain fuel components with properties outside of these ranges, since the properties of an overall blend may differ, often significantly, from those of its individual constituents.

In accordance with one aspect of the invention, there is provided the use of diheterocyclo diazene dicarboxamide to achieve a desired cetane number of the resultant fuel composition. In some embodiments the desired cetane number is achieved or intended to be achieved under a specified set or range of engine working conditions, as described elsewhere herein. Accordingly, an advantage of the present invention is that diheterocyclo diazene dicarboxamide may be suitable for reducing the combustion delay of a fuel composition under all engine running conditions, or under mild, or under harsh engine conditions, or demanding engine such as turbo charged engine.

In operating a compression ignition engine and/or a vehicle which is powered by such an engine, the diesel fuel composition discussed above is introducing into a combustion chamber of the engine and then running (or operating) the engine.

Diheterocyclo diazene dicarboxamide may serve to improve combustion and, hence, improve associated engine factors, such as exhaust emissions and/or engine deposits under a range of engine operating conditions. Diheterocyclo diazene dicarboxamide may also be used as an additive for gasoline.

To facilitate a better understanding of the present invention, the following examples of certain aspects of some embodiments are given. In no way should the following examples be read to limit, or define, the entire scope of the invention.

ILLUSTRATIVE EMBODIMENTS

The fuel blends were prepared with the diesel base fuel listed in Table 1 below.

Examples 1-3

Azodicarboyl dipiperidine (AZDP) was blended in the diesel base fuel.

Procedure to prepare 100 g of blend solution containing 0.05% AZDP and Base Fuel I is as follows: 0.05 g of AZDP was added to 99.95 g of Base Fuel in a glass container and stirred until a clear homogenous solution was obtained (Example 1).

Procedure to prepare 100 g of blend solution containing 0.1% AZDP and Base Fuel I is as follows: 0.1 g of AZDP was added to 99.9 g of Base Fuel in a glass container and stirred until a clear homogenous solution was obtained (Example 2).

Procedure to prepare 100 g of blend solution containing 0.2% AZDP and Base Fuel I is as follows: 0.2 g of AZDP was added to 99.8 g of Base Fuel in a glass container and stirred until a clear homogenous solution was obtained (Example 3).

Cetane numbers were obtained from IQT tests and shown below in Table 2.

TABLE 2

| Fuel\Cetane Number | Trial 1 | Trial 2 | Average | Standard Deviation | Average Ignition Delay (ms) |
|---|---|---|---|---|---|
| Base Fuel | 48.2 | 48.6 | 48.4 | ±0.28 | 4.25 |
| Base Fuel + 0.05% AZDP (Example 1) | 51.5 | 51.9 | 51.7 | ±0.28 | 3.95 |
| Base Fuel + 0.1% AZDP (Example 2) | 53.2 | 53.2 | 53.2 | ±0.00 | 3.83 |
| Base Fuel + 0.2% AZDP (Example 3) | 55.3 | 55.5 | 55.4 | ±0.14 | 3.67 |

AZDP additized percentages are shown on weight basis.

Blend solutions containing 2-EHN were also prepared similarly. In FIG. 1, cetane number was plotted with increased concentration of AZDP compared with 2-EHN in Base fuel I.

FIG. 1 shows that the cetane number increase obtained by adding AZDP at various concentrations to diesel base fuel is equal or higher than that obtained by using the ethylhexyl nitrate (2-EHN) cetane improver.

Example 4 and Comparative Example 1

Azodicarboyl dipiperidine (AZDP) and Dioctyl diazene dicarboxamide (DODD) was blended in the diesel base fuel with 1-butanol as co-solvent.

The procedure to prepare 100 g of blend solution containing 20% w/w 1-butanol, 0.25% W/W AZDP and the remaining as diesel fuel was as follows: Add 0.25 g of AZDP to 20 g of 1-butanol and 79.75 g of diesel fuel (Base Fuel I) followed by stiffing in a glass container until a clear homogenous solution is obtained.

This procedure can be extended to other co-solvents such as primary alcohols containing 1-20 carbon atoms.

Dioctyl diazene dicarboxamide (DODD) was blended in the diesel base fuel with 1-butanol as co-solvent.

The procedure to prepare 100 g of blend solution containing 20% w/w 1-butanol, 0.25% w/w DODD and the remaining as diesel fuel was as follows: Add 0.25 g of DODD to 20 g of 1-butanol in a glass container. Bath sonicate the mixture for 1 min and then add 29.75 g of diesel. Probe sonicate the resulting mixture until a clear homogenous solution is obtained. Add 50 g of diesel fuel (Base Fuel II) to this mixture in order to obtain 100 g of the blended fuel.

Cetane numbers were obtained from IQT tests and shown below in Table 3.

TABLE 3

| Fuel\Cetane Number | Trial 1 | Trial 2 | Average | Standard Deviation | Average Ignition Delay (ms) | Cetane Number Change |
|---|---|---|---|---|---|---|
| Base Fuel + 1-Butanol | 40.7 | 40.8 | 40.75 | ±0.07 | 5.14 | 0.0 |
| Base Fuel + 1-Butanol + 0.25% DODD (Comparative Example 1) | 43 | 43 | 43 | ±0.0 | 4.84 | 2.3 |
| Base Fuel + 1-Butanol | 39.6 | 39.1 | 39.35 | ±0.35 | 5.34 | 0.0 |
| Base Fuel + 1-Butanol + 0.25% AZDP (Example 4) | 46.3 | 45.7 | 46 | ±0.42 | 4.50 | 6.7 |

Table 3 shows that the cetane number increase obtained by adding 0.25% of AZDP is about three times that obtained by using 0.25% of DODD thereby showing that AZDP results in a significant improvement in cetane number increase compared to DODD.

Example 5

Azodicarboyl dipiperidine (AZDP) and 2-ethylhexyl nitrate (2-EHN) were blended in the diesel base fuel.

2-EHN and AZDP were added together to diesel fuel (Base Fuel I) at 0.05% w/w each and compared with cetane increase obtained by adding 0.1% w/w of 2-EHN to diesel fuel by itself.

Cetane numbers were obtained from IQT tests and shown below in Table 4.

TABLE 4

| Fuel + Additive | Cetane Number | Cetane Number Increase |
|---|---|---|
| Base Fuel | 48.4 | — |
| Base Fuel + 0.1% 2-EHN | 52.75 | 4.35 |
| Base Fuel + 0.05% 2-EHN + 0.05% AZDP | 52.95 | 4.55 |

Materials

AZDP and 2-EHN were obtained from Sigma Aldrich Co. DODD was obtained from Obiter Research LLC. A commercially available Base Diesel Fuel I having the property in Table 1 or Base Diesel Fuel II having the property in Table 1 was used.

TABLE 1

Base Fuel Properties

| Base Fuel Property | Base Fuel I | Base Fuel II |
|---|---|---|
| API | 36.8 | 38.0 |
| Kinematic Viscosity @ 40° C. | 2.46 $mm^2/s$ | 2.37 $mm^2/s$ |
| Flash Point | 60.0° C. | 58.5° C. |
| Cetane Number | 48.4 | 48.9 |
| Sulfur | 6 mg/kg | 5 mg/kg |

Thermal Stability

Figure 2:
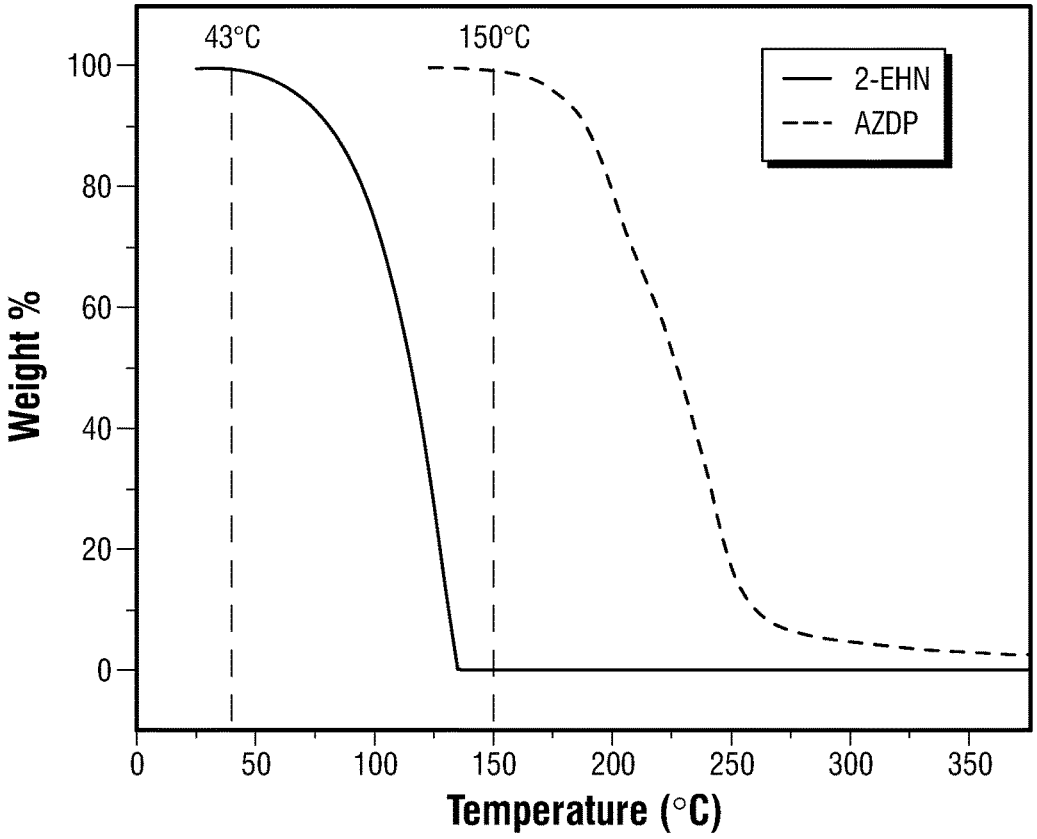
FIG. 2 shows the decomposition profile of 2-EHN and azodicarbonyl dipiperidine, a diheterocyclo diazene dicarboxamide, by thermo gravimetric analysis.

Thermogravimetric analysis (TGA) was used to evaluate the thermal stabilities of the azodicarboyl dipiperidine (AZDP) and compared to 2-EHN. The TGA was run at atmospheric pressure under nitrogen at a ramp rate of 10° C./min. The result is shown in FIG. 2. The TGA shows that AZDP is more stable to decomposition then 2-EHN and does not start to decompose until more than 100 degrees after 2-EHN decomposes.

I claim:

1. A diesel fuel composition comprising a diesel base fuel and at least one diheterocyclo diazene dicarboxamide having the formula:

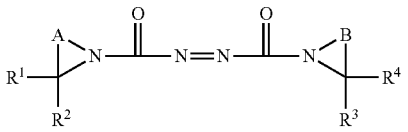

wherein $R^1$, $R^2$, $R^3$ and $R^4$ are each the same or different groups selected from alkyl groups or hydrogen, and A and B are same or different alkylene group having 3 to 5 carbon atoms or nitrogen containing aliphatic group having 1 nitrogen atom and 2 to 4 carbon atoms.

2. The composition of claim 1 wherein the heterocyclic group of the diheterocyclo diazene dicarboxamide contains a 5 or 6 member heterocyclic group.

3. The composition of claim 1 wherein each of the carbon atoms in A and B are optionally substituted with the same or different groups

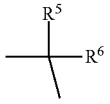

wherein $R^5$ and $R^6$ are each the same or different groups selected from alkyl groups and hydrogen.

4. The composition of claim 3 wherein each of the $R^1$, $R^2$, $R^3$, $R^4$, $R^5$, and $R^6$ are independently hydrogen or alkyl groups having 1 to 5 carbon atoms.

5. The composition of claim 1 wherein the diheterocyclo diazene dicarboxamide has the formula:

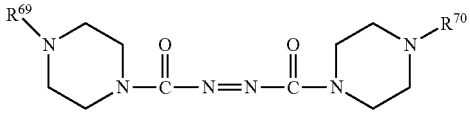

wherein $R^{69}$ $R^{70}$ are each independently selected from hydrogen or alkyl groups having 1 to 4 carbon atoms.

6. The composition of claim 1 wherein the diheterocyclo diazene dicarboxamide is selected from the group consisting of azodicarbonyl dipiperidine, and methanone, 1,1'-(1,2-diazenediyl)bis[1-(1-pyrrolidinyl)-diimide].

7. The composition of claim 1 wherein the diheterocyclo diazene dicarboxamide has the formula:

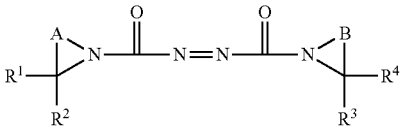

wherein $R^1$, $R^2$, $R^3$ and $R^4$ are each the same or different groups selected from alkyl groups or hydrogen, and A and B are same or different alkylene group having 3 to 5 carbon atoms.

8. The composition of claim 7 wherein each of the carbon atoms in A and B are optionally substituted with the same or different groups

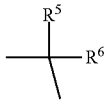

wherein $R^5$ and $R^6$ are each the same or different groups selected from alkyl groups and hydrogen.

9. The composition of claim 8 wherein each of the $R^1$, $R^2$, $R^3$, $R^4$, $R^5$, and $R^6$ are independently hydrogen or alkyl groups having 1 to 5 carbon atoms.

10. The composition of claim 1 wherein the diheterocyclo diazene dicarboxamide is azodicarbonyl dipiperidine.

11. The composition of claim 1 wherein the diheterocyclo diazene dicarboxamide is present in an amount of 0.005 to 5% based on the diesel fuel composition.

12. A method for operating a compression ignition engine and/or a vehicle which is powered by such an engine, which method comprises introducing into a combustion chamber of the engine a diesel fuel composition containing at least one diheterocyclo diazene dicarboxamide and running said engine, wherein the diheterocyclo diazene dicarboxamide has the formula:

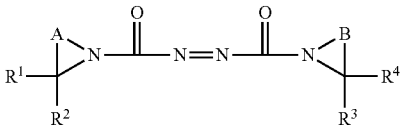

wherein $R^1$, $R^2$, $R^3$ and $R^4$ are each the same or different groups selected from alkyl groups or hydrogen, and A and B are same or different alkylene group having 3 to 5 carbon atoms or nitrogen containing aliphatic group having 1 nitrogen atom and 2 to 4 carbon atoms.

13. The composition of claim 12 wherein each of the carbon atoms in A and B are optionally substituted with the same or different groups

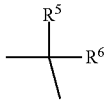

wherein $R^5$ and $R^6$ are each the same or different groups selected from alkyl groups and hydrogen.

14. The composition of claim 13 wherein each of the $R^1$, $R^2$, $R^3$, $R^4$, $R^5$, and $R^6$ are independently hydrogen or alkyl groups having 1 to 5 carbon atoms.

15. The composition of claim 12 wherein the diheterocyclo diazene dicarboxamide is azodicarbonyl dipiperidine.

* * * * *